US009850747B2

(12) United States Patent
Ma et al.

(10) Patent No.: US 9,850,747 B2
(45) Date of Patent: Dec. 26, 2017

(54) FISSURED SUBSTRATA WATER PUMPING APPARATUS AND METHOD

(71) Applicant: CHINA UNIVERSITY OF MINING AND TECHNOLOGY, Xuzhou (CN)

(72) Inventors: Zhanguo Ma, Xuzhou (CN); Guozhen Zhao, Xuzhou (CN); Fan Zhang, Xuzhou (CN); Peng Gong, Xuzhou (CN); Zhongxi Jiang, Xuzhou (CN); Jianli Yang, Xuzhou (CN); Xinli Zhang, Xuzhou (CN); Zhanlin Ma, Xuzhou (CN); Yunjing Ma, Xuzhou (CN)

(73) Assignee: CHINA UNIVERSTIY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 15/005,847

(22) Filed: Jan. 25, 2016

(65) Prior Publication Data

US 2016/0138374 A1 May 19, 2016

Related U.S. Application Data

(63) Continuation of application No. PCT/CN2014/072176, filed on Feb. 18, 2014.

(30) Foreign Application Priority Data

Jul. 26, 2013 (CN) ..... 2013 1 0321522

(51) Int. Cl.
*E21B 43/00* (2006.01)
*E21B 43/32* (2006.01)
(Continued)

(52) U.S. Cl.
CPC ..... *E21B 43/121* (2013.01); *E21B 43/32* (2013.01); *E21F 16/00* (2013.01)

(58) Field of Classification Search
None
See application file for complete search history.

(56) References Cited

U.S. PATENT DOCUMENTS 3,971,437 A * 7/1976 Clay ..... E21B 33/127 166/187
5,611,671 A * 3/1997 Tripp, Jr. ..... E21B 43/121 417/118

(Continued)

FOREIGN PATENT DOCUMENTS

CN 2641290 Y 9/2004
CN 101008317 A 8/2007

(Continued)

OTHER PUBLICATIONS

The World Intellectual Property Organization (WIPO) International Search Report for PCT/CN2014/072176 dated May 28, 2014.

*Primary Examiner* — Matthew R Buck
*Assistant Examiner* — Douglas S Wood
(74) *Attorney, Agent, or Firm* — Anova Law Group, PLLC

(57) ABSTRACT

The present invention provides a fissured substrata water pumping apparatus and methods thereof. The fissured substrata water pumping apparatus includes a water pumping pipe inserted into a drilled hole under a roadway floor; one or more unidirectional water-blocking plates configured inside the water pumping pipe; a servo pump; and an annular drainage siphon having a first end connected to an upper end of the water pumping pipe, and a second end connected to an inlet end of the servo pump through a valve.

20 Claims, 2 Drawing Sheets

(51) Int. Cl.

| | |
|---|---|
| ***E21F 16/00*** | (2006.01) |
| ***E21B 33/12*** | (2006.01) |
| ***E21B 43/40*** | (2006.01) |
| ***F04F 1/06*** | (2006.01) |
| ***F04F 3/00*** | (2006.01) |
| ***E21B 43/12*** | (2006.01) |

(56) References Cited

U.S. PATENT DOCUMENTS

| | | | | | |
|---|---|---|---|---|---|
| 5,709,505 | A | * | 1/1998 | Williams | B09C 1/005 166/268 |
| 6,123,149 | A | * | 9/2000 | McKinzie | E21B 43/121 166/106 |
| 6,131,655 | A | * | 10/2000 | Shaw | E21B 43/12 166/105.5 |

FOREIGN PATENT DOCUMENTS

| | | | |
|---|---|---|---|
| CN | 201963342 | U | 9/2011 |
| CN | 102635402 | A | 8/2012 |
| CN | 102966376 | A | 3/2013 |
| CN | 103382851 | A | 11/2013 |
| CN | 203412623 | U | 1/2014 |
| JP | H0979000 | A | 3/1997 |
| JP | 2001336400 | A | 12/2001 |
| JP | 2004083244 | A | 3/2004 |

* cited by examiner

FISSURED SUBSTRATA WATER PUMPING APPARATUS AND METHOD

CROSS-REFERENCES TO RELATED APPLICATIONS

This application is a continuation application of PCT Patent Application No. PCT/CN2014/072176, filed on Feb. 18, 2014, which claims the priority of Chinese Patent Application No. 201310321522.7, filed on Jul. 26, 2013, the entire contents of all of which are incorporated herein by reference.

FIELD OF THE DISCLOSURE

The present disclosure generally relates to the technical field of drainage apparatus and method and, more particularly, relates to an apparatus and method for pumping and draining fissured substrata water in fissure-growing surrounding rocks, soft surrounding rocks and water-seeping surrounding rocks in mines, tunnels and underground projects.

BACKGROUND

Fissure-growing surrounding rocks, soft surrounding rocks and water-seeping surrounding rocks are often encountered in mines, tunnels and underground projects. These surrounding rocks may include weak interlayers, mudstone interlayers, various structural surfaces and various composite structures. The soft surrounding rocks with a mudstone interlayer may be prone to swelling and weathering. Further, as affected by both water and dynamic pressures, mudstones may easily become muddy when touching water. Other accompanying phenomenon may include water seeping, damping and softened mass, floor heaves in a roadway, etc. When a floor anchoring method is used to support these types of surrounding rocks, it is difficult to install rock bolts and form an effective anchoring force. Further, after the supporting measures are implemented, bottom heaves and fissured floor in the roadway may still occur when there is seeping water, which affects roadway usage and production safety.

Thus, there is a need to provide a fissured substrata water pumping apparatus and method to discharge water under roadway floor, and thus preventing water accumulation at the bottom plate which may soften the surrounding rocks, and preventing and reducing floor heaves.

The disclosed method and system are directed to solve one or more problems set forth above and other problems in the art.

BRIEF SUMMARY OF THE DISCLOSURE

One aspect of the present disclosure provides a fissured substrata water pumping apparatus, including a water pumping pipe inserted into a drilled hole under a roadway floor; one or more unidirectional water-blocking plates configured inside the water pumping pipe; a servo pump; and an annular drainage siphon having a first end connected to an upper end of the water pumping pipe, and a second end connected to an inlet end of the servo pump through a valve.

Optionally, a sealant is filled between an outer wall of the upper end of the water pumping pipe and an inner wall of an opening of the drilled-hole. A plurality of suction holes is configured on the outer wall of the water pumping pipe by a space interval between adjacent suction holes along an axial direction of the water pumping pipe.

Optionally, the first end of the annular drainage siphon connected to the water pumping pipe is positioned higher than the second end of the annular drainage connected to the servo pump.

Optionally, one or more rubber water-resisting rings are configured to surround the outer wall of the water pumping pipe. The one or more rubber water-resisting rings contain expanding agents.

Optionally, a plurality of barbs is configured on the outer wall of the water pumping pipe.

Optionally, the one or more unidirectional water-blocking plates are configured to include an eccentric pin which opens and closes in one direction.

Optionally, each suction hole has an axial center perpendicular to the outer wall of the water pumping pipe; and at a same horizontal level, only one suction hole is punctured through wall of the water pumping pipe.

Optionally, the servo pump is a constant pressure self-regulating pump.

Optionally, the water pumping pipe is made of stainless steel.

Optionally, a water sink configured to connect with an outlet end of the servo pump via a hose.

Another aspect of the present disclosure provides a fissured substrata water pumping method by inserting a water pumping pipe to a drilled hole. When the water pumping pipe is secured in the drilled hole, the drilled hole is sealed by filling a sealant between an outer wall of an upper end of the water pumping pipe and an inner wall of an opening of the drilled hole. The water pumping pipe is connected with an annular drainage siphon, and a servo pump. The annular drainage siphon has a first end connected to an upper end of the water pumping pipe, and a second end connected to an inlet end of the servo pump through a valve. The valve is opened and the servo pump is turned on to automatically pump substrata fissure water from the drilled hole.

Optionally, the first end of the annular drainage siphon connected to the water pumping pipe is positioned higher than the second end of the annular drainage connected to the servo pump.

Optionally, one or more unidirectional water-blocking plates are configured inside the water pumping pipe.

Optionally, a plurality of suction holes are configured on the outer wall of the water pumping pipe by a space interval between adjacent suction holes along an axial direction of the water pumping pipe.

Optionally, before inserting the water pumping pipe, a plurality of pipe segments are connected as the water pumping pipe. The pipe segments are configured based on rock layers corresponding to the drilled hole. One or more connections between adjacent pipe segments are surrounded with one or more rubber water-resisting rings containing expanding agents.

Optionally, a plurality of barbs is configured on the outer wall of the water pumping pipe. When the water pumping pipe reaches a bottom of the drilled hole, the water pumping pipe is pulled back to ensure that the barbs are stuck into the inner wall of the drilled hole and the water pumping pipe is secured in the drilled hole.

Optionally, the annular drainage siphon is fixated on a side wall of the drilled hole.

Optionally, the servo pump is a constant pressure self-regulating pump; a constant pressure is configured for the servo pump using a gauge; and the servo pump automatically turns on or turns off according to fissured substrata water pressure in the drilled hole.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to the drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention.

The present disclosure provides an apparatus for pumping fissured substrata water. The disclosed apparatus may be used in a roadway in tunnels, mines and underground projects. The roadway floor is built on rock layers (i.e., substrata). Fissured substrata water, as used herein, may refer to water in the fissured rock layers under the roadway floor. Hereinafter, fissured substrata water may be simply referred to as water.

Figure 1:
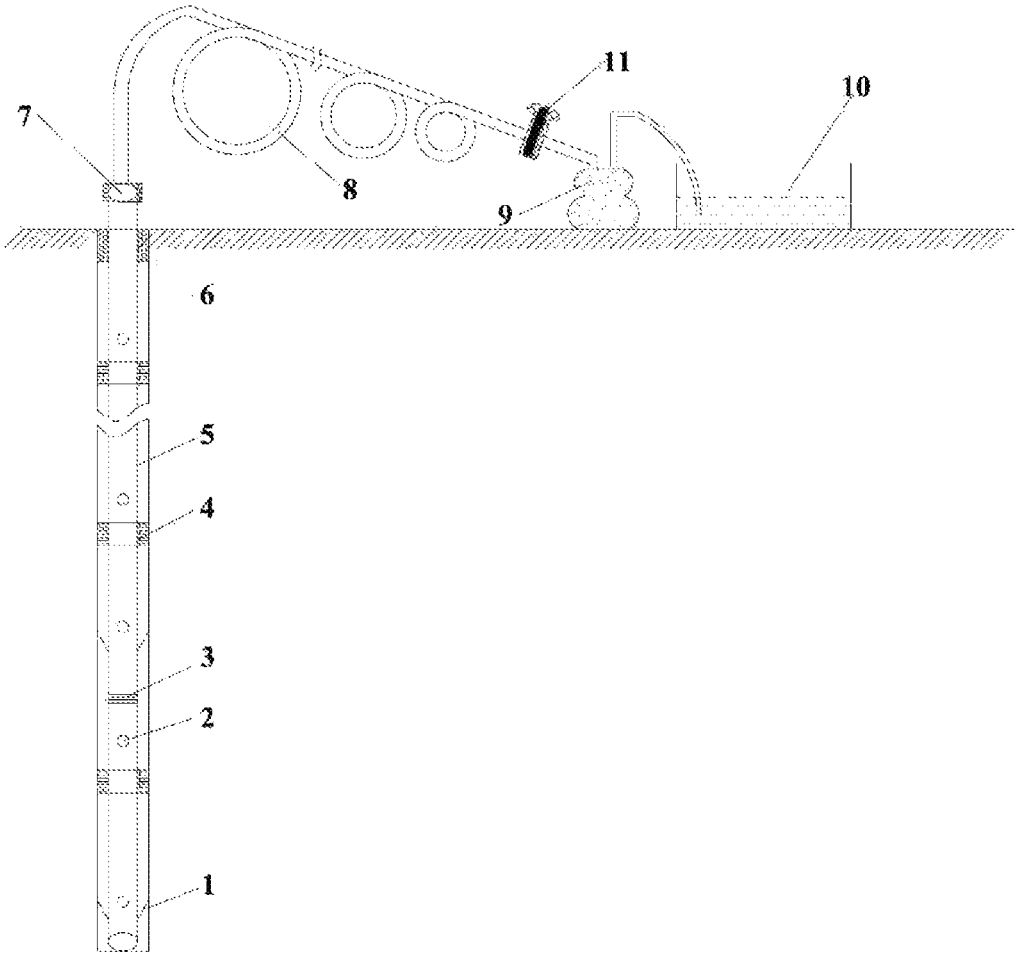
FIG. 1 illustrates a structural diagram of an exemplary apparatus for pumping fissured substrata water consistent with the disclosed embodiments.

As shown in FIG. 1, the exemplary apparatus may include a water pumping pipe 5, an annular drainage siphon 8, a servo pump 9, and a water tank 10. The water pumping pipe 5 may have accessories including one or more unidirectional water-blocking plates 3 and one or more rubber water-resisting rings 4. One or more suction holes 2 may be punctured on the outer wall of the water pumping pipe 5. The outer wall of the water pumping pipe 5 may be further equipped with multiple barbs 1.

A hole may be drilled starting from a bottom floor in a roadway and extending to a depth under the floor into the substrata. The water pumping pipe 5 may be configured to insert into the drilled hole. One end of the water pumping pipe 5 is above the drilled hole and may be connected with the annular drainage siphon 8. The annular drainage siphon 8 is connected with the servo pump 9.

The water pumping pipe 5 may be made of seamless stainless steel. Multiple suction holes 2 may be arranged on the outer wall of the water pumping pipe 5 with space intervals along axial direction. Further, multiple barbs 1 may be arranged on the outer wall of the water pumping pipe 5 with space intervals along axial direction.

In some embodiments, the water pumping pipe 5 may include a plurality of connected pipe segments. A rubber water-resisting ring 4 may be configured to surround a connection between adjacent pipe segments. In some embodiments, the rubber water-resisting ring 4 may be placed at any specified location on the outer wall of the water pumping pipe 5. Further, the rubber water-resisting ring 4 may contain expanding agents. The rubber water-resisting ring 4 may expand and contact the inner wall of the drilled hole. Therefore, when the water pumping pipe 5 is inserted into the drilled hole, the rubber water-resisting ring 4 may expand at a level depending on the depth of a corresponding rock layer, preventing water at upper layers from dripping down to the lower layer of along the drilled hole.

In some embodiments, the locations of the rubber water-resisting rings 4 may be configured based on corresponding rock layer thickness. For example, the water pumping pipe 5 may be inserted into the drilled hole crossing four rock layers from top to bottom. The water pumping pipe 5 may be configured to include four pipe segments, and the length of each pipe segment may be configured to be comparable with a corresponding rock layer. The rubber water-resisting rings 4 may be configured to surround connections between adjacent pipe segments.

One or more unidirectional water-blocking plates 3 may be configured inside the water pumping pipe 5. The unidirectional water-blocking plate 3 may be configured to include an eccentric pin which opens and closes in one direction, e.g., an upward direction. When there is no water, the unidirectional water-blocking plate 3 may fall freely under the force of gravity and maintain a closed status at horizontal level, such that water may accumulate above the unidirectional water-blocking plate 3 in the water pumping pipe 5. When water comes from lower part of the water pumping pipe 5, the unidirectional water-blocking plate 3 may be pushed open by the force of the upcoming water.

In some embodiments, the locations of the unidirectional water-blocking plates 3 may be configured based on corresponding rock layer thickness. For example, the water pumping pipe 5 may be inserted into the drilled hole crossing five rock layers from top to bottom. At corresponding depth range of each rock layer, at least one unidirectional water-blocking plate 3 may be configured inside the water pumping pipe 5.

Sealant 6 may be filled between the outer wall of the outlet end (i.e., upper end) of the water pumping pipe 5 and the inner wall of the drilled-hole opening, i.e., the opening of the drilled hole. A connector 7 may be configured to connect the outlet end of the water pumping pipe 5 with one end (i.e., a first end) of the annular drainage siphon 8. The other end (i.e., a second end) of the annular drainage siphon 8 may be connected with the inlet end of the servo pump 9 through a valve 11. The servo pump 9 may be a constant pressure self-regulating pump. The outlet end of the servo pump 9 may be connected to the sink 10 via a hose. Further, the first end of the annular drainage siphon 8 connected with the water pumping pipe 5 is configured to be higher than the second end of the annular drainage siphon 8 connected with the servo pump 9. The annular drainage siphon 8 may include multiple loops of circle. For example, as shown in FIG. 1, the annular drainage siphon may include a number of sub-annular-drainage-siphons, at least including a first, second, and third sub-annular-drainage -siphons between the first end and the second end of the annular drainage siphon. The first sub-annular-drainage-siphon may have a first diameter and may be connected to the water pumping pipe. The second sub-annular-drainage-siphon may have a second diameter and may be connected to the first sub-annular-drainage-siphon. The third sub-annular-drainage-siphon may have a third diameter and may be connected to the second sub-annular-drainage-siphon. The first diameter may be greater than the second diameter, which may be greater than the third diameter. The first, second and third sub-annular-drainage-siphons may be connected to together provide a top connection line having one slope with the ground. The annular drainage siphon 8 may prevent air from flowing into the water pumping pipe 5.

The opening of each suction hole 2 may be perpendicular to the outer wall of the water pumping pipe 5. At a same horizontal level, only one suction hole 2 may be punctured. In other words, any two suction holes 2 may not occur at a same cross-section of the water pumping pipe 5.

The water pumping pipe 5 and the first end of the annular drainage siphon 8 together may function as a siphon such that water inside the water pumping pipe 5 may move uphill because of surface tension. Specifically, after sealant 6 is filled between the upper end of the water pumping pipe 5 and the drilled-hole opening, a confined space may form between the outer wall of the water pumping pipe 5 and the inner wall of the drilled hole. Because limited gas or air content exist among the rock layers, the pressure difference may not be great enough to ensure occurrence of the siphon effect. In this occasion, the siphon effect is achieved based on characteristics of surface tension. That is, the diameter of the water pumping pipe 5 may be small enough to allow water inside the water pumping pipe 5 to move uphill because of surface tension.

Further, water may travel inside the annular drainage siphon 8 from the first end (i.e. the higher end) to the second end (i.e., the lower end). Under the force of gravity, moving speed of the water flow may increase in the annular drainage siphon 8, which builds negative pressure in the water pumping pipe 5 and ensures the siphon effect.

The servo pump 9 may maintain a constant pressure. When the pressure from the fissured substrata water is lower than a preset threshold (e.g., less accumulated water may have slower moving speed when reaching the lower end of the annular drainage siphon 8 and the inlet end of the servo pump 9), the servo pump 9 may automatically turn off. When the water pressure is higher than a preset threshold, the servo pump 9 may automatically turn on and pump water into the sink. The valve 11 may adjust the water flow.

Figure 2:
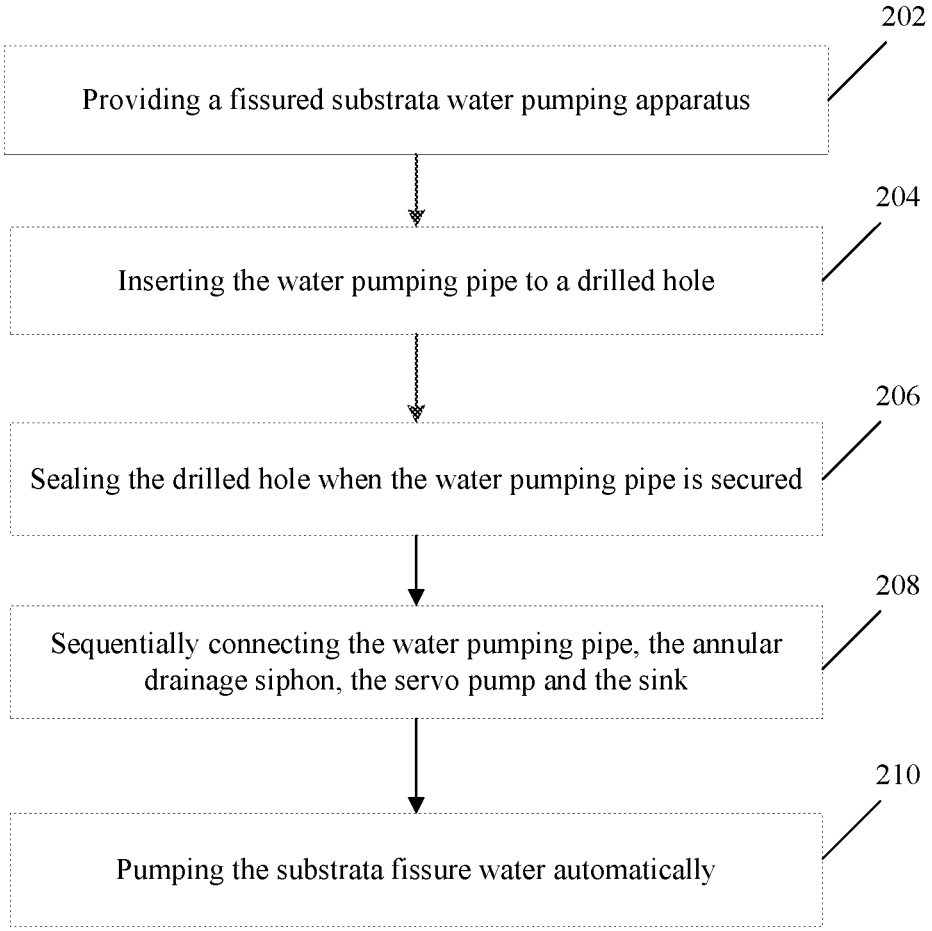
FIG. 2 illustrates a flow chart of an exemplary process for pumping fissured substrata water consistent with the disclosed embodiments.

The present disclosure provides a method for pumping fissured substrata water. As shown in FIG. 2, an exemplary process for pumping fissured substrata water may include the following steps.

The disclosed apparatus for pumping fissured substrata water may be installed (S202). Based on gathered information about fissured substrata water at the specific location, multiple suction holes 2 may be punctured on the outer wall of the water pumping pipe 5. One or more the unidirectional water-blocking plates 3 may be installed inside the water pumping pipe 5. Multiple barbs 1 may be installed on the outer wall of the water pumping pipe 5. The rubber water-resisting rings 4 may surround connections between any two pipe segments.

The water pumping pipe 5 may be inserted to a drilled hole (S204). The drilled hole may be drilled in the floor and extend to a depth underground. The length of the water pumping pipe 5 may be greater than the depth of the drilled hole. That is, the lower end of the water pumping pipe 5 may reach the bottom of the drilled hole, while the upper end of the water pumping pipe 5 may include a part above the floor.

After being inserted to the drilled hole and reaching the bottom of the drilled hole, the water pumping pipe 5 may be pulled back to ensure that the barbs 1 are stuck into the inner wall of the drilled hole, such that the water pumping pipe 5 is tightly inserted and anchored in the drilled hole and may not be easily moved vertically.

When the water pumping pipe 5 is secured in the drilled hole, the drilled hole may be sealed (S206). Sealant 6 may be filled between the outer wall of the outlet end of the water pumping pipe 5 and the inner wall of the drilled-hole opening. Thus, the space between the drilled hole and the water pumping pipe 5 are sealed.

Further, the water pumping pipe 5, the annular drainage siphon 8, the servo pump 9, and the sink 10 may be sequentially connected (S208). A connector 7 may be used to connect the outlet end of the water pumping pipe 5 with one end of the annular drainage siphon 8. The other end of the annular drainage siphon 8 may be connected with the inlet end of the servo pump 9. The valve 11 may be configured at the inlet end of the servo pump 9 to control water flow. The outlet end of the servo pump 9 may be connected to the sink 10 via a hose or a pipe. The annular drainage siphon 8 may be fixated at the side part of the roadway or tunnel.

The servo pump 9 may pump and drain the fissured substrata water through the annular drainage siphon 8 (S210). When the valve 11 is open and the servo pump 9 is powered, a constant pressure may be configured for the servo pump 9 using a gauge. Thus, the servo pump 9 may automatically turn on or turn off according to the fissured substrata water pressure, and the water flow may be controlled.

The present disclosure fully considers combined characteristics of fissure-growing surrounding rocks, soft surrounding rocks and water-seeping surrounding rocks in mines, tunnels and underground projects, and provides an apparatus and method for pumping fissured substrata water. The present disclosure applies the law of communicating vessels and principle of a siphon to pump water from fissured substrata, and prevents soft rock supporting system from hydration and failure. Further, a valve is configured to control water flow, which ensures the reliability, safety and longevity of the soft rock supporting system when there is substrata fissure water. The disclosed apparatus has simple structure and low production cost. The disclosed apparatus and method are easy to implement, reliable and effective.

A rubber water-resisting ring 4 may be configured to encase or surround a connection between pipe segments. The rubber water-resisting ring 4 may contain expanding agents. Based on the water seepage situation in the rock layers, the water-resisting ring 4 may be an effective barrier against accumulated water and prevent the accumulated water in different rock layers from flowing towards the bottom of the drilled hole. Further, the sealant 6 are filled between the outer wall of the outlet end of the water pumping pipe 5 and the inner wall of the drilled-hole opening, which may actively block water and prevent weathering.

The other end of the annular drainage siphon 8 are connected with the inlet end of the servo pump 9 through the valve 11, which may effectively control water flow and prevent air from going into the drilled hole, such that the rock layers may not be weathered.

The unidirectional water-blocking plates 3 are configured inside the water pumping pipe 5, which may prevent water collected at a higher part of the pipe from flowing to a lower part of the pipe. Thus, the rock layers near the lower part of the pipe may not be swollen and fissured because of long-time water immersion.

The servo pump 9 that connects to the annular drainage siphon 8 is a constant pressure self-regulating pump. The servo pump 9 may automatically switch between on and off based on the pressure in the water pumping pipe 5, which builds energy-efficient pumping cycles.

The disclosed apparatus is not only simple and easy to implement, but can also reduce supporting costs and effectively enhance stability of surrounding rocks.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

What is claimed is:

1. A fissured substrata water pumping apparatus, comprising:

a water pumping pipe inserted into a drilled hole under a roadway floor;

one or more unidirectional water-blocking plates configured inside the water pumping pipe;

a plurality of barbs each capable of having one end on an outer wall of the water pumping pipe and another end on an inner wall of the drilled hole to insert and anchor the water pumping pipe in the drilled hole without moving vertically;

a servo pump; and an annular drainage siphon having a first end connected to an upper end of the water pumping pipe, and a second end connected to an inlet end of the servo pump through a valve.

2. The apparatus according to claim 1, wherein:

a sealant is filled between an outer wall of the upper end of the water pumping pipe and an inner wall of an opening of the drilled-hole, and a plurality of suction holes are configured on the outer wall of the water pumping pipe by a space interval between adjacent suction holes along an axial direction of the water pumping pipe.

3. The apparatus according to claim 1, wherein:

the first end of the annular drainage siphon connected to the water pumping pipe is positioned higher than the second end of the annular drainage connected to the servo pump.

4. The apparatus according to claim 1, further comprising:

one or more rubber water-resisting rings configured to surround the outer wall of the water pumping pipe, wherein the one or more rubber water-resisting rings contain expanding agents surrounding connections between adjacent pipe segments of the water pumping pipe.

5. The apparatus according to claim 1, further comprising:

one end on the outer wall of the water pumping pipe is lower than the another end on the inner wall of the drilled hole.

6. The apparatus according to claim 1, wherein:

the one or more unidirectional water-blocking plates are configured to include an eccentric pin which opens and closes in one direction.

7. The apparatus according to claim 2, wherein:

each suction hole has an axial center perpendicular to the outer wall of the water pumping pipe; and at a same horizontal level, only one suction hole is punctured through wall of the water pumping pipe.

8. The apparatus according to claim 1, wherein:

the servo pump is a constant pressure self-regulating pump.

9. The apparatus according to claim 1, wherein:

the water pumping pipe is made of stainless steel.

10. The apparatus according to claim 1, further comprising:

a water sink configured to connect with an outlet end of the servo pump via a hose.

11. The apparatus according to claim 3, wherein:

the annular drainage siphon includes a number of sub-annular-drainage-siphons, at least including a first, second, and third sub-annular-drainage-siphons between the first end and the second end of the annular drainage siphon, the first sub-annular-drainage-siphon has a first diameter and is connected to the water pumping pipe, the second sub-annular-drainage-siphon has a second diameter and is connected to the first sub-annular-drainage-siphon, the third sub-annular-drainage-siphon has a third diameter and is connected to the second sub-annular-drainage-siphon, the first diameter is greater than the second diameter, which is greater than the third diameter, and the first, second and third sub-annular-drainage-siphons are connected to together provide a top connection line having one slope with the ground.

12. A fissured substrata water pumping method, comprising:

inserting a water pumping pipe to a drilled hole, wherein a plurality of barbs each is capable of having one end on an outer wall of the water pumping pipe and another end on an inner wall of the drilled hole to insert and anchor the water pumping pipe in the drilled hole without moving vertically;

when the water pumping pipe is secured in the drilled hole, sealing the drilled hole by filling a sealant between an outer wall of an upper end of the water pumping pipe and an inner wall of an opening of the drilled hole;

connecting the water pumping pipe with an annular drainage siphon, and a servo pump, wherein the annular drainage siphon has a first end connected to an upper end of the water pumping pipe, and a second end connected to an inlet end of the servo pump through a valve; and opening the valve and turning on the servo pump to automatically pump substrata fissure water from the drilled hole.

13. The method according to claim 12, further comprising:

positioning the first end of the annular drainage siphon connected to the water pumping pipe higher than the second end of the annular drainage connected to the servo pump.

14. The method according to claim 12, wherein one or more unidirectional water-blocking plates are configured inside the water pumping pipe.

15. The method according to claim 12, wherein a plurality of suction holes are configured on the outer wall of the water pumping pipe by a space interval between adjacent suction holes along an axial direction of the water pumping pipe.

16. The method according to claim 12, before inserting the water pumping pipe, further comprising:

connecting a plurality of pipe segments as the water pumping pipe, wherein the pipe segments are configured based on rock layers corresponding to the drilled hole; and surrounding one or more connections between adjacent pipe segments with one or more rubber water-resisting rings containing expanding agents.

17. The method according to claim 12, further comprising:

configuring a plurality of barbs on the outer wall of the water pumping pipe, and when the water pumping pipe reaches a bottom of the drilled hole, pulling back the water pumping pipe to ensure that the barbs are stuck into the inner wall of the drilled hole and the water pumping pipe is secured in the drilled hole.

18. The method according to claim 12, further comprising:

fixating the annular drainage siphon on a side wall of the drilled hole.

19. The method according to claim 12, wherein:

the servo pump is a constant pressure self-regulating pump;

a constant pressure is configured for the servo pump using a gauge; and the servo pump automatically turns on or turns off according to fissured substrata water pressure in the drilled hole.

20. The method according to claim 13, further comprising:

the annular drainage siphon includes a number of sub-annular-drainage-siphons, at least including a first, second, and third sub-annular-drainage-siphons between the first end and the second end of the annular drainage siphon, the first sub-annular-drainage-siphon has a first diameter and is connected to the water pumping pipe, the second sub-annular-drainage-siphon has a second diameter and is connected to the first sub-annular-drainage-siphon, the third sub-annular-drainage-siphon has a third diameter and is connected to the second sub-annular-drainage-siphon, the first diameter is greater than the second diameter, which is greater than the third diameter, and the first, second and third sub-annular-drainage-siphons are connected to together provide a top connection line having one slope with the ground.

* * * * *